US007625301B2

(12) United States Patent
Komatsu

(10) Patent No.: US 7,625,301 B2
(45) Date of Patent: Dec. 1, 2009

(54) GOLF BALL

(75) Inventor: Atsushi Komatsu, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 12/119,190

(22) Filed: May 12, 2008

(65) Prior Publication Data

US 2008/0220900 A1 Sep. 11, 2008

Related U.S. Application Data

(63) Continuation-in-part of application No. 11/712,964, filed on Mar. 2, 2007, now abandoned.

(51) Int. Cl.
*A63B 37/06* (2006.01)

(52) U.S. Cl. ..... 473/374

(58) Field of Classification Search ..... 473/374, 473/373, 376, 377

See application file for complete search history.

(56) References Cited

U.S. PATENT DOCUMENTS

| | | | |
|---|---|---|---|
| 5,306,760 | A | 4/1994 | Sullivan |
| 5,312,857 | A | 5/1994 | Sullivan |
| 6,565,455 | B2 | 5/2003 | Hayashi et al. |
| 6,656,059 | B2 | 12/2003 | Umezawa et al. |
| 6,939,907 | B2 | 9/2005 | Rajagopalan et al. |
| 6,962,951 | B1 | 11/2005 | Takesue et al. |
| 2005/0170910 | A1* | 8/2005 | Hayashi ..... 473/371 |

FOREIGN PATENT DOCUMENTS

| | | | |
|---|---|---|---|
| JP | 2002-345999 | A | 12/2002 |
| JP | 2003-175130 | A | 6/2003 |
| JP | 3729243 | B2 | 10/2005 |
| JP | 3772252 | B2 | 2/2006 |
| JP | 2006-087948 | A | 4/2006 |
| WO | 98/46671 | A1 | 10/1998 |

* cited by examiner

*Primary Examiner*—Raeann Trimiew
(74) *Attorney, Agent, or Firm*—Sughrue Mion, PLLC

(57) ABSTRACT

The invention provides a golf ball composed of a core, an intermediate layer which encases the core, and a cover which encases the intermediate layer. The core has a diameter of 36 to 40 mm and a deflection of 3.5 to 4.2 mm, and the intermediate layer has a Shore D hardness of 45 to 55 and a thickness of 0.6 to 1.6 mm. The cover has a Shore D hardness of 63 to 66 and a thickness of 0.6 to 1.6. The ball as a whole has a deflection of 2.6 to 3.5 mm, and the intermediate layer and cover have a combined thickness of 1.8 to 2.8 mm. The ball has a hardness design such that the Shore D hardnesses of the ball components satisfy the relationship core center≦core surface≦intermediate layer≦cover, and the cover is made of a material composed primarily of a thermoplastic resin or a thermoplastic elastomer. The intermediate layer is made of a material that is a resin composition in which at least 90 mol % of the acid groups are neutralized. This combination of characteristics provides the golf ball with a sufficient spin rate-lowering effect, thus increasing the distance traveled, and also confers the ball with a good feel on impact and an excellent durability to cracking.

9 Claims, 1 Drawing Sheet

GOLF BALL

CROSS-REFERENCE TO RELATED APPLICATION

Figure 1:
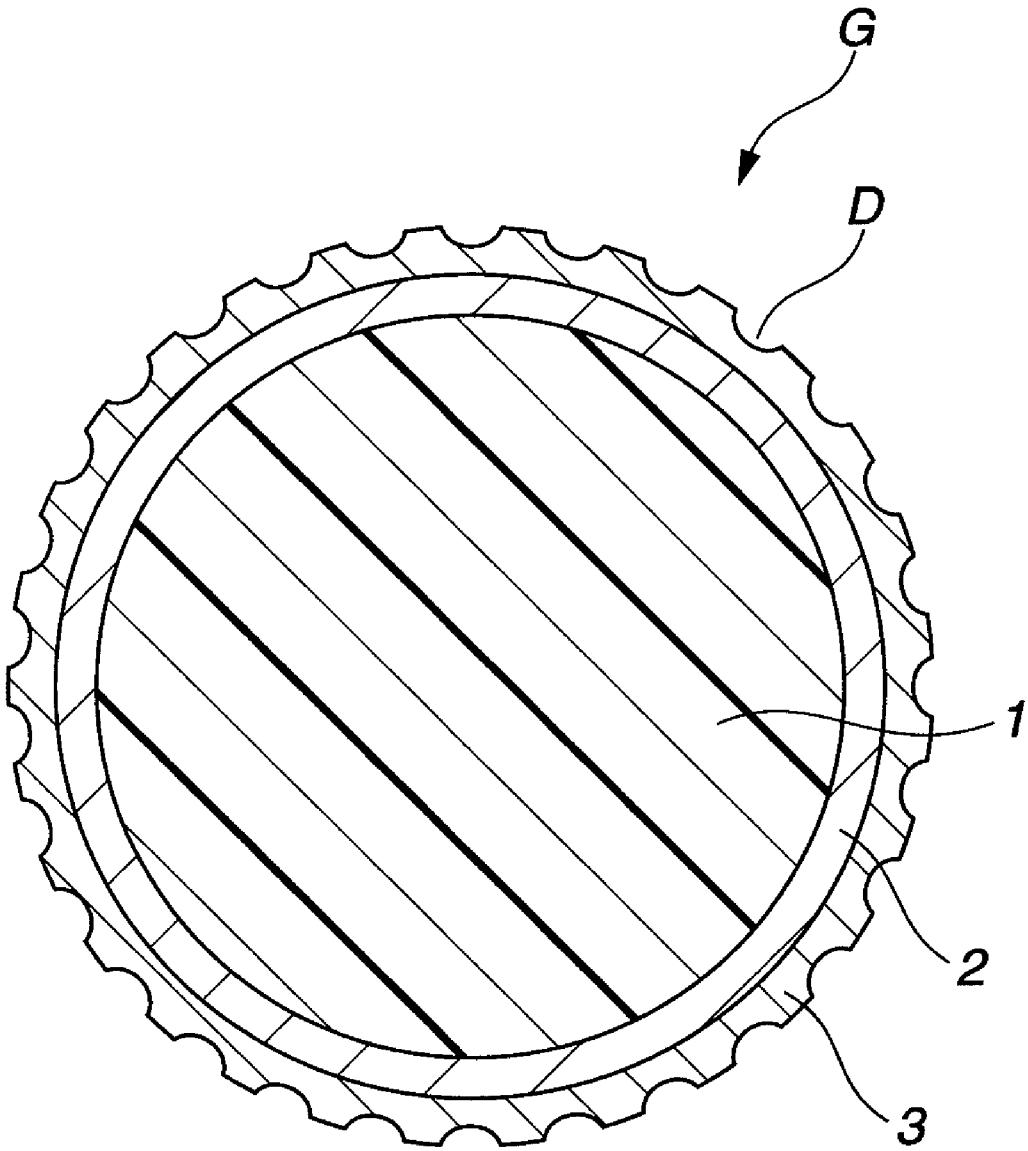

This application is a continuation-in-part of application Ser. No. 11/712,964 filed on Mar. 2, 2007, the entire contents of which are hereby incorporated by reference.

BACKGROUND OF THE INVENTION

The present invention relates to a golf ball of three or more layers, including a core, an intermediate layer and a cover, which ball has an excellent feel on impact, controllability and flight performance.

Golf club performance has been improving in recent years, one effect of which has been a significant decline in the spin rate of the golf ball after it is hit. However, the spin rate tends to remain high under the hitting conditions of the average golfer (golfers having an average score), which accounts for the majority golfers. Hence, by achieving a lower ball spin rate, there remains room for increasing the distance traveled by the ball.

Art for increasing the distance includes improvements to the material making up the intermediate layer sandwiched between the core and the cover serving as the outermost layer. For example, JP-A 2003-175130 discloses a highly neutralized intermediate layer material in which the degree to which an ionomer resin or the like has been neutralized is set relatively high.

However, in such a golf ball, the use of a soft cover is presumed. That is, the ball does not have a construction in which a hard cover is used to take full advantage of the properties of a high-resilience intermediate layer.

JP-A 2006-87948 teaches a golf ball which uses an intermediate layer material having a high degree of neutralization. Such a ball does have an improved rebound, but there remains room for improvement as a spin rate-lowering construction.

Highly neutralized intermediate layer materials have also been disclosed in, for example, JP No. 3729243, JP No. 3772252 and JP-A 2002-345999. However, in all of these disclosures, there remains room for further improvement in terms of fully exploiting the high resilience of the intermediate layer and reducing the spin rate. Moreover, these prior-art golf balls leave something to be desired not only in their distance of travel, but also in their feel on impact and their durability to cracking.

SUMMARY OF THE INVENTION

It is therefore an object of the present invention to provide a golf ball of three or more layers, including a core, an intermediate layer and a cover, which ball, even when hit under conditions typical of an average golfer using a driver, achieves a sufficient reduction in the spin rate of the ball and thus increases the distance of travel, and moreover has an excellent feel on impact and an excellent durability to cracking.

Based on extensive investigations conducted in order to achieve the above object, the inventor has found that if an intermediate layer composed of a specific resin mixture and having a high resilience is used, if the thicknesses and hardnesses of the intermediate layer and a hard cover are selected so as to provide the intermediate layer and the cover at optimal gages, if the diameter and the deflection hardness of the core are optimized, and if the ball is given a hardness design in which the Shore D hardnesses of the respective parts of the ball satisfy the relationship $$\text{core center} \leqq \text{core surface} \leqq \text{intermediate layer} \leqq \text{cover},$$

when the ball is played with a driver by an average golfer, a sufficient spin rate-lowering effect will be achieved, increasing the distance traveled by the ball. Moreover, the ball also will have an excellent feel on impact and an excellent durability to cracking.

That is, when a golf ball is hit with a driver, first a force acts in such a way as to apply spin to the golf ball, then an opposite force acts to suppress the spin. In the present invention, by giving the intermediate layer a high resilience, the timing of the switch to the force that acts to suppress spin is speeded up. As a result, a lower spin rate is achieved. However, when the ball is hit with a driver, if the rigidity of the cover is not maintained, the intermediate layer will be flattened to such a degree that its high resilience will be of no avail and a lower spin rate will not be achieved. In view of this, the inventor has discovered that, to maximize the force that suppresses spin, creating a ball construction that combines a highly resilient intermediate layer with a hard cover is very effective for achieving the objects of the invention.

More specifically, the golf ball of the invention has a construction that is able to achieve the maximum reduction in spin rate, even among distance balls in which the distance traveled by the ball when hit with a driver is of particular importance. In prior-art distance balls, the two fundamental approaches have been: (i) to make the cover hard so as to increase the initial velocity of the ball on impact and thus achieve a reduced spin rate; and (ii) to make the intermediate layer hard so as to increase the initial velocity of the ball on impact and thus achieve a reduced spin rate. A drawback of both such prior-art balls is the harder feel on impact. Hence, to increase the distance traveled by the ball while imparting a good feel on impact, the hardnesses of the intermediate layer and the cover have been subject to certain limits. The inventor thus conceived of a golf ball in which the hardnesses of the cover and the intermediate layer are increased to the upper limit at which the feel of the ball is not compromised, and in which, by having the intermediate layer made of a high-resilience material, the timing of the force that suppresses ball spin is speeded up, enabling a reduced spin rate to be achieved.

Accordingly, the invention provides the following golf balls.

[1] A golf ball comprising a core, an intermediate layer which encases the core, and a cover which encases the intermediate layer, wherein the core has a diameter of between 36 and 40 mm and a deflection of between 3.5 and 4.2 mm, the intermediate layer has a Shore D hardness of between 45 and 55 and a thickness of between 0.6 and 1.6 mm, the cover has a Shore D hardness of between 63 and 66 and a thickness of between 0.6 and 1.6, the ball as a whole has a deflection of between 2.6 and 3.5 mm, the intermediate layer and cover have a combined thickness of between 1.8 and 2.8 mm, the ball has a hardness design such that the Shore D hardnesses of the ball components satisfy the relationship $$\text{core center} \leqq \text{core surface} \leqq \text{intermediate layer} \leqq \text{cover},$$

the cover is made of a material composed primarily of a thermoplastic resin or a thermoplastic elastomer, and the intermediate layer is made of a material that is a resin composition containing a heated mixture which has a melt flow rate according to JIS K-7210 of at least 0.5 g/10 min and which is selected from among (I) to (III) below:

(I)

(a) 100 parts by weight of an olefin-unsaturated carboxylic acid random copolymer and/or an olefin-unsaturated carboxylic acid-unsaturated carboxylic acid ester random copolymer, (b) from 5 to 80 parts by weight of a fatty acid or fatty acid derivative having a molecular weight of at least 280, and (c) from 0.1 to 20 parts by weight of a basic inorganic metal compound capable of neutralizing the acid groups in components (a) and (b);

(II)

(d) 100 parts by weight of a metal ion neutralization product of an olefin-unsaturated carboxylic acid random copolymer and/or a metal ion neutralization product of an olefin-unsaturated carboxylic acid-unsaturated carboxylic acid ester random copolymer, (b) from 5 to 80 parts by weight of a fatty acid or fatty acid derivative having a molecular weight of at least 280, and (c) from 0.1 to 20 parts by weight of a basic inorganic metal compound capable of neutralizing the acid groups in components (d) and (b);

(III)

100 parts by weight of, in admixture, (a) an olefin-unsaturated carboxylic acid random copolymer and/or an olefin-unsaturated carboxylic acid-unsaturated carboxylic acid ester random copolymer and (d) a metal ion neutralization product of an olefin-unsaturated carboxylic acid random copolymer and/or a metal ion neutralization product of an olefin-unsaturated carboxylic acid-unsaturated carboxylic acid ester random copolymer, (b) from 5 to 80 parts by weight of a fatty acid and/or fatty acid derivative having a molecular weight of at least 280, and (c) from 0.1 to 20 parts by weight of a basic inorganic metal compound capable of neutralizing the acid groups in components (a), (d) and (b);

at least 90% of the acid groups in the resin composition being neutralized.

[2] The golf ball of [1], wherein 100 mol % of the acid groups in the resin composition serving as the intermediate layer material are neutralized.

[3] The golf ball of [1], wherein the core has a difference in Shore D hardness between the core surface and the core center of from 5 to 15.

[4] The golf ball of [1] which has a surface on which a plurality of dimples are formed, the dimples numbering in all from 250 to 370, having an overall volume of from 400 to 700 $mm^3$, and having a surface coverage of at least 79%.

[5] The golf ball of [1], wherein the intermediate layer material has a melt flow rate of from 0.5 to 1.0 g/10 min, and the cover material and the intermediate layer material have a melt flow rate difference therebetween of at least 1.0 g/10 min.

BRIEF DESCRIPTION OF THE DIAGRAMS

FIG. 1 is a schematic sectional view of a golf ball (3-layer construction) according to an embodiment of the invention.

DETAILED DESCRIPTION OF THE INVENTION

The invention is described more fully below in conjunction with the accompanying diagram. Referring to the diagram, the golf ball of the invention has a construction of at least three layers which includes a core 1, an intermediate layer 2 that encloses the core 1, and a cover 3 that encloses the intermediate layer 2. A plurality of dimples D are formed on the surface of the cover 3. In the arrangement shown in FIG. 1, the core 1, the intermediate layer 2 and the cover 3 are each composed of one layer, although any of these components of the ball may be composed of a plurality of two or more layers. If necessary, the core 1, the intermediate layer 2 and the cover 3 may each be composed of a plurality of layers. In arrangements where the core, the intermediate layer and/or the cover described below has a multilayer construction, all the necessary conditions for a particular component shall be satisfied for the plurality of layers making up that particular component as a whole.

A known core material, such as a rubber composition, may be used in the core of the inventive ball. The use of polybutadiene as the base rubber is especially preferred. The polybutadiene is exemplified by cis-1,4-polybutadiene having a cis structure of at least 40%.

The rubber composition may include, as a crosslinking agent, a zinc or magnesium salt of an unsaturated fatty acid, such as zinc methacrylate or zinc acrylate, or an ester compound such as trimethylpropane methacrylate. The use of zinc acrylate is especially preferable for achieving a high resilience. Such a crosslinking agent may be included in an amount of at least 5 parts by weight but not more than 40 parts by weight per 100 parts by weight of the base rubber.

The rubber composition may include also a vulcanizing agent, such as dicumyl peroxide or a mixture of dicumyl peroxide and 1,1-bis(t-butylperoxy)-3,3,5-trimethylcyclohexane. The amount of vulcanizing agent included may be set to at least 0.1 part by weight but not more than 5 parts by weight per 100 parts by weight of the base rubber. A commercial product, such as Percumyl D (produced by NOF Corporation) may be suitably used as the dicumyl peroxide.

In addition, it is possible to include also an antioxidant and a filler for regulating the specific gravity, such as zinc oxide or barium sulfate. Such a filler may be incorporated in an amount of from 0 part by weight to 130 parts by weight per 100 parts by weight of the base rubber.

Also, in the present invention, it is preferable not to compound an organosulfur compound such as pentachlorothiophenol into the core material in order to prevent a spin rate-lowering effect of the intermediate layer material having a high resilience when the rebound of the core is enhanced. It may be conducted that the adjustment of the initial velocity of the ball according to the seasonal variation, and in light of considering of the above-point, it is preferable to add the organosulfur in an amount of not more than 0.1 part by weight per 100 parts by weight of the base rubber.

To obtain a core from the above core-forming rubber composition, the composition may be masticated with a conventional apparatus such as a Banbury mixer, kneader or roll mill, and the resulting compound compression-molded using a core mold.

In the practice of the invention, the center of the core must have a Shore D hardness which satisfies the following relationships with respect to the Shore D hardnesses of the subsequently described intermediate layer and cover:

hardness at center of core≦hardness of intermediate layer≦hardness of cover;

preferably, hardness at center of core≦hardness at core surface≦hardness of intermediate layer≦hardness of cover;

and more preferably, the hardness increases gradually from the center of the core to the outside surface of the cover.

These relationships are described more fully later in the specification.

The Shore D hardness of the core is suitably adjusted in accordance with the Shore D hardnesses of the intermediate layer and the cover and is not subject to any particular limitation, provided it satisfies the above relationship. However, it is advantageous for the Shore D hardness at the center of the core to be generally not more than 35, and preferably not more than 30, but at least 15, and preferably at least 20. It is recommended that the Shore D hardness at the surface of the core be suitably adjusted in accordance with the Shore D hardness at the center of the core. A value of generally not more than 50, and especially not more than 45, but at least 30, and especially at least 35, is preferred.

The Shore D hardness difference between the core center and the core surface, while not subject to any particular limitation, is preferably at least 5 but not more than 15. This is because, while it is generally thought that a larger core hardness gradient will produce a better spin rate-lowering effect, in the present invention, owing to the presence of a relatively hard cover, a large core hardness gradient will result in a construction that works against a spin rate-lowering effect, thus having instead an adverse influence. Accordingly, when the cover is hard as in the present invention, a smaller core hardness gradient will result in a lower spin rate. That is, a modest core hardness gradient, such as one which falls within the above range, is suitable for the core structure of the invention.

The core in the invention has a diameter of at least 36 mm, and preferably at least 37 mm, but not more than 40 mm, and preferably not more than 39 mm. If the core diameter is too small, the intermediate layer and the cover will be thicker, the feel of the ball on impact will worsen, the spin rate will increase, and the distance traveled by the ball will decrease. On the other hand, if the core diameter is too large, the intermediate layer and the cover will be thinner, and the durability to cracking and the scuff resistance will worsen.

The core of the invention has a deflection (mm), when subjected to a compressive load of 130 kgf from an initial load state of 10 kgf, of preferably at least 3.5 mm, but preferably not more than 4.2 mm. If the deflection by the core is smaller than that indicated above, the feel on impact will be harder, which is not desirable. On the other hand, if the deflection by the core is larger than that indicated above, the ball as a whole will incur excessive deformation, resulting in a decrease in the desirable effects of the intermediate layer.

As shown in FIG. 1, in the golf ball of the invention, the core 1 has formed thereover so as to enclose it, in order, at least one intermediate layer 2 and a cover 3 as the outermost layer. Of these components, the intermediate layer is made of a resin composition containing a heated mixture of (a) an olefin-unsaturated carboxylic acid random copolymer and/or an olefin-unsaturated carboxylic acid-unsaturated carboxylic acid ester random copolymer or (d) a metal ion neutralization product of an olefin-unsaturated carboxylic acid random copolymer and/or an olefin-unsaturated carboxylic acid-unsaturated carboxylic acid ester random copolymer alone, or both components (a) and (d), in combination with (b) a fatty acid or fatty acid derivative having a molecular weight of at least 280, and (c) a basic inorganic metal compound capable of neutralizing the acid groups in the foregoing components. Components (a) to (d) are described in detail below.

The olefin in the above component (a) has a number of carbons which is generally at least 2 but not more than 8, and preferably not more than 6. Specific examples include ethylene, propylene, butene, pentene, hexene, heptene and octene. Ethylene is especially preferred.

Examples of the unsaturated carboxylic acid include acrylic acid, methacrylic acid, maleic acid and fumaric acid. Acrylic acid and methacrylic acid are especially preferred.

Moreover, the unsaturated carboxylic acid ester is preferably a lower alkyl ester of the above unsaturated carboxylic acid. Specific examples include methyl methacrylate, ethyl methacrylate, propyl methacrylate, butyl methacrylate, methyl acrylate, ethyl acrylate, propyl acrylate and butyl acrylate. Butyl acrylate (n-butyl acrylate, i-butyl acrylate) is especially preferred.

The random copolymer of component (a) may be obtained by random copolymerizing the above components in accordance with a known method. Here, it is recommended that the unsaturated carboxylic acid content (acid content) present in the random copolymer be generally at least 2 wt %, preferably at least 6 wt %, and more preferably at least 8 wt %, but not more than 25 wt %, preferably not more than 20 wt %, and even more preferably not more than 15 wt %. At a low acid content, the material may have a lower resilience, whereas at a high acid content, the processability of the material may decrease.

The random copolymer neutralization product serving as component (d) can be obtained by neutralizing some of the acid groups on the above-described random copolymer with metal ions. Here, illustrative examples of the metal ions for neutralizing the acid groups include $Na^+$, $K^+$, $Li^+$, $Zn^{++}$, $Cu^{++}$, $Mg^{++}$, $Ca^{++}$, $Co^{++}$, $Ni^{++}$ and $Pb^{++}$. Of these, preferred use can be made of, for example, $Na^+$, $Li^+$, $Zn^{++}$ and $Mg^{++}$. The use of $Zn^{++}$ is even more preferred. No particular limitation is imposed on the degree to which such metal ions neutralize the random copolymer. Such a neutralization product may be obtained by a known method. For example, a compound such as a formate, acetate, nitrate, carbonate, bicarbonate, oxide, hydroxide or alkoxide of the above-mentioned metal ions may be used to introduce the metal ions to the above-described random copolymer.

Illustrative examples of the random copolymers that may be used as above component (a) include Nucrel AN4311, Nucrel AN4318 and Nucrel 1560 (all products of DuPont-Mitsui Polychemicals Co., Ltd.). Illustrative examples of the random copolymer neutralization products that may be used as above component (d) include Himilan 1554, Himilan 1557, Himilan 1601, Himilan 1605, Himilan 1706, Himilan 1855, Himilan 1856 and Himilan AM7316 (all products of DuPont-Mitsui Polychemicals Co., Ltd.), and Surlyn 6320, Surlyn 7930 and Surlyn 8120 (all products of E.I. DuPont de Nemours & Co.). The use of a zinc-neutralized ionomer resin (e.g., Himilan AM7316) is especially preferred.

The random copolymer of above component (a) and the neutralization product of above component (d) may be used, either singly or in combination, as the base resin. If both are used in combination, the proportions therebetween are not subject to any particular limitation.

Above component (b) is a fatty acid or fatty acid derivative having a molecular weight of at least 280. It is a component which improves the flow properties of the heated mixture. Compared with the thermoplastic resin serving as above component (a), this component has a very low molecular weight and helps to greatly increase the melt viscosity of the mixture. Because the fatty acid (or derivative thereof) of the invention has a molecular weight of at least 280 and includes a high content of acid groups (or derivatives thereof), the loss in resilience due to the addition thereof is small.

The fatty acid or fatty acid derivative of component (b) may be an unsaturated fatty acid (or derivative thereof) containing a double bond or triple bond on the alkyl moiety, or it may be a saturated fatty acid (or derivative thereof) in which the bonds on the alkyl moiety are all single bonds. It is recommended that the number of carbons on the molecule be generally at least 18, but not more than 80, and preferably not more than 40. Too few carbons may make it impossible to improve the heat resistance, which is an object of the invention, and may also make the acid group content so high as to diminish the flow-improving effect due to interactions with acid groups present in the base resin. On the other hand, too many carbons increases the molecular weight, as a result of which the flow-improving effect may diminish.

Specific examples of the fatty acid of component (b) include stearic acid, 1,2-hydroxystearic acid, behenic acid, oleic acid, linoleic acid, linolenic acid, arachidic acid and lignoceric acid. Of these, stearic acid, arachidic acid, behenic acid and lignoceric acid are preferred.

The fatty acid derivative in the invention is a compound in which the proton on the acid group of the fatty acid has been replaced. Such fatty aid derivatives are exemplified by metallic soaps in which the proton on the acid group of the fatty acid has been replaced with a metal ion. Examples of the metal ion include $Li^{+}$, $Ca^{++}$, $Mg^{++}$, $Zn^{++}$, $Mn^{++}$, $Al^{+++}$, $Ni^{++}$, $Fe^{++}$, $Fe^{+++}$, $Cu^{++}$, $Sn^{++}$, $Pb^{++}$ and $Co^{++}$. Of these, $Ca^{++}$, $Mg^{++}$ and $Zn^{++}$ are especially preferred.

Specific examples of fatty acid derivatives that may be used as component (b) include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred.

Moreover, use may be made of known metal soap-modified ionomers (such as those mentioned in U.S. Pat. Nos. 5,312,857, 5,306,760 and International Application WO 98/46671) when using the above-described component (a) and/or (d) and component (b).

In the intermediate layer material of the invention, a basic inorganic filler capable of neutralizing acid groups in above component (a) and/or (d) and in above component (b) may be added as component (c). However, as mentioned in the prior-art examples, when component (a) and/or (d) and component (b) alone, and in particular a metal-modified ionomer resin alone (e.g., a metal soap-modified ionomer resin of the type mentioned in the above patent publications, alone), is heated and mixed, as shown below, the metallic soap and un-neutralized acid groups present on the ionomer undergo exchange reactions, generating a fatty acid. Because the fatty acid has a low thermal stability and readily vaporizes during molding, it causes molding defects. Moreover, if the fatty acid thus generated deposits on the surface of the molded material, it may substantially lower paint film adhesion.

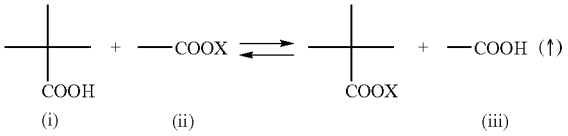

(i) un-neutralized acid group present on the ionomer resin
(ii) metallic soap
(iii) fatty acid
X: metal cation To solve this problem, the material includes also, as component (c), a basic inorganic metal compound which neutralizes the acid groups present in above components (a) and/or (d) and component (b). The inclusion of component (c) as an essential ingredient confers excellent properties. That is, the acid groups in above components (a) and/or (d) and component (b) are neutralized, and synergistic effects from the blending of each of these respective components increase the thermal stability of the heated mixture while at the same time conferring a good moldability and thus enhancing the resilience as a golf ball-forming material.

It is recommended that above component (c) be a basic inorganic metal compound, preferably a monoxide, which is capable of neutralizing acid groups in above components (a) and/or (d) and in component (b). Because such compounds have a high reactivity with the ionomer resin and the reaction by-products contain no organic matter, the degree of neutralization of the heated mixture can be increased without a loss of thermal stability.

The metal ions used here in the basic inorganic metal compound are exemplified by $Li^{+}$, $Na^{+}$, $K^{+}$, $Ca^{++}$, $Mg^{++}$, $Zn^{++}$, $Al^{+++}$, $Ni^{+}$, $Fe^{++}$, $Fe^{+++}$, $Cu^{++}$, $Mn^{++}$, $Sn^{++}$, $Pb^{++}$ and $Co^{++}$. Illustrative examples of the inorganic metal compound include basic inorganic fillers containing these metal ions, such as magnesium oxide, magnesium hydroxide, magnesium carbonate, zinc oxide, sodium hydroxide, sodium carbonate, calcium oxide, calcium hydroxide, lithium hydroxide and lithium carbonate. As noted above, a monoxide is preferred. The use of magnesium oxide, which has a high reactivity with ionomer resins, is especially preferred.

The above intermediate layer material prepared as described above from components (a), (d), (b) and (c) can be provided with an improved thermal stability, moldability and resilience. To achieve these ends, the components must be formulated in certain proportions. Specifically, it is essential to include, per 100 parts by weight of component (a) and/or component (d) (referred to below as the "base resin"), at least 5 parts by weight, but not more than 80 parts by weight, preferably not more than 40 parts by weight, and more preferably not more than 20 parts by weight, of component (b); and at least 0.1 part by weight but not more than 20 parts by weight, preferably not more than 10 parts by weight, and more preferably not more than 5 parts by weight, of component (c). Too little component (b) lowers the melt viscosity, resulting in a poor processability, whereas too much lowers the durability. Too little component (c) fails to improve thermal stability and resilience, whereas too much instead lowers the heat resistance of the composition due to the presence of excess basic inorganic metal compound.

The above-described material may be used directly as the heated mixture, or other ingredients may be suitably included in the mixture. In either case, the heated mixture preferably has a melt flow rate, as measured according to JIS K-7210, of at least 0.5 g/10 min, and more preferably at least 1.0 g/10 min. Because relatively low flow properties in the intermediate layer material enables the desired resilience to be achieved, it is desirable for the heated mixture to also have low flow properties. However, if the heated mixture has a low melt flow rate, the result will be a marked decline in processability.

It is preferable for the above mixed material to be characterized by, in infrared absorption spectroscopy, the relative absorbance at the absorption peak attributable to carboxylate anion stretching vibrations at 1530 to 1630 $cm^{-1}$ with respect to the absorbance at the absorption peak attributable to carbonyl stretching vibrations normally detected at 1690 to 1710 $cm^{-1}$. This ratio may be expressed as follows: (absorbance at absorption peak for carboxylate anion stretching vibrations)/(absorbance at absorption peak for carbonyl stretching vibrations).

Here, "carboxylate anion stretching vibrations" refers to vibrations by carboxyl groups from which the proton has dissociated (metal ion-neutralized carboxyl groups), and "carbonyl stretching vibrations" refers to vibrations by undissociated carboxyl groups. The ratio between these respective peak intensities depends on the degree of neutralization. In the ionomer resins having a degree of neutralization of about 50 mol % which are commonly used, the ratio between these peak absorbances is about 1:1.

To improve the thermal stability, moldability and resilience of the intermediate layer material, it is recommended that the above heated mixture have a carboxylate anion stretching vibration peak absorbance which is at least 1.5 times, and preferably at least 2 times, the carbonyl stretching vibration peak absorbance. The absence of any carbonyl stretching vibration peak is especially preferred.

The thermal stability of the above heated mixture can be measured by thermogravimetry. It is recommended that, in thermogravimetry, the heated mixture have a weight loss at 250° C., based on the weight of the mixture at 25° C., of generally not more than 2 wt %, preferably not more than 1.5 wt %, and more preferably not more than 1 wt %.

Although not subject to any particular limitation, it is recommended that the specific gravity of the heated mixture proper be generally at least 0.9, but not more than 1.5, preferably not more than 1.3, and more preferably not more than 1.1.

The heated mixed is obtained by heating and mixing the above-described component (a) and/or component (d), component (b) and component (c), and has an optimized melt flow rate.

It is recommended that at least 90 mol %, and most preferably at least 100 mol %, of the acid groups in the heated mixture be neutralized. Such a high degree of neutralization makes it possible to more reliably suppress the exchange reactions that are a problem when only the above-described base resin and the fatty acid (or a derivative thereof) are used, thus preventing the formation of fatty acids. As a result, there can be obtained a material which has a greatly increased thermal stability and a good moldability, and which moreover has a much improved resilience compared with prior-art ionomer resins.

Here, with regard to the neutralization of the above heated mixture, to more reliably achieve both a high degree of neutrality and good flow, it is recommended that the acid groups in the heated mixture be neutralized with transition metal ions and with alkali metal and/or alkaline earth metal ions. Transition metal ions have a weaker ionic cohesion than alkali metal and alkaline earth metal ions and so neutralize some of the acid groups in the heated mixture, enabling the flow properties to be significantly improved.

The molar ratio between the transition metal ions and the alkali metal and/or alkaline earth metal ions is set as appropriate, generally in a range of 10:90 to 90:10, and preferably 20:80 to 80:20. Too low a molar ratio of transition metal ions may fail to provide sufficient improvement in the flow properties of the material. On the other hand, a molar ratio that is too high may lower the resilience.

Specific examples of such metal ions include zinc ions as the transition metal ions and at least one type of ion selected from among sodium, lithium and magnesium ions as the alkali metal or alkaline earth metal ions.

No particular limitation is imposed on the method used to obtain the heated mixture in which the acid groups have been neutralized with transition metal ions and alkali metal or alkaline earth metal ions. Specific examples of methods of neutralization with transition metal ions, particularly zinc ions, include a method in which a zinc soap is used as the fatty acid derivative, a method in which a zinc ion neutralization product is included as component (d) in the base resin (e.g., a zinc-neutralized ionomer resin), and a method in which zinc oxide is used as the basic inorganic metal compound of component (c).

To obtain the intermediate layer material, it suffices to use the above heated mixture as an essential component. The advantageous effects of the invention can be effectively exhibited by including the heated mixture in an amount, expressed as a proportion of the overall intermediate layer material (overall resin composition), of preferably at least 50 wt %, more preferably at least 60 wt %, and even more preferably at least 70 wt %. In addition, various additives such as pigments, dispersants, antioxidants, ultraviolet absorbers and optical stabilizers may be included within the foregoing resin composition in which the above heated mixture serves as an essential component. To improve the feel of the golf ball on impact, the material of the invention may also include, in addition to the above essential components, various non-ionomeric thermoplastic elastomers. Illustrative examples of such non-ionomeric thermoplastic elastomers include olefin elastomers, styrene elastomers, ester elastomers and urethane elastomers. The use of olefin elastomers and styrene elastomers is especially preferred. A commercial product such as Dynaron, a hydrogenated polymer produced by JSR Corporation, may be used as the olefin elastomer.

The method of preparing the above-described resin composition is not subject to any particular limitation. For example, mixture may be carried out under heating at a temperature of between 150 and 250° C. in an internal mixer such as a kneading-type twin-screw extruder, a Banbury mixer or a kneader. The method of incorporating the various additives other than the essential ingredients in the above resin composition, while not subject to any particular limitation, is exemplified by a method in which the additives are blended together with the essential ingredients and at the same time mixed under heating, and a method in which the essential ingredients are first mixed together under heating, following which the optional additives are added and further mixing under heating is carried out.

The method of forming the intermediate layer is not subject to any particular limitation. For example, the intermediate layer may be formed by a known injection molding or compression molding process using the above resin composition. When injection molding is employed, the process may involve placing a prefabricated core at a given position in an injection molding mold, then introducing the above-described material into the mold. When compression molding is employed, the process may involve producing a pair of half cups from the above-described material, enclosing the core with these cups, then applying heat and pressure within a mold. If molding under heat and pressure is carried out, the molding conditions employed may be a temperature of from 120 to 170° C. and a period of from 1 to 5 minutes.

The intermediate layer is formed of a resin composition composed primarily of the above-described heated mixture, but is not limited to a single layer. If the intermediate layer is composed of two or more layers, at least one such layer will be made of the above heated mixture. Any of various known resin materials may be used in the other layer or layers.

Specifically, use may be made of, for example, the rubber composition described above as the core-forming material, or a thermoplastic resin.

Thermoplastic resins that may be used as the other intermediate layer material are exemplified by ionomer resins and by thermoplastic elastomers such as polyester elastomers, polyamide elastomers, polyurethane elastomers, olefin elastomers and styrene elastomers. Such elastomers are commercially available as, for example, Hytrel (produced by DuPont-Toray Co., Ltd.), Pelprene (produced by Toyobo Co., Ltd.), Pebax (produced by Atochem Co.), Pandex (Dainippon Ink & Chemicals, Inc.), Santoprene (Monsanto) and Tuftec (Asahi Chemical Industry Co., Ltd.). Commercially available ionomer resins include Himilan (produced by DuPont-Mitsui Polychemicals Co., Ltd.), Surlyn (E.I. DuPont de Nemours & Co.), and Iotek (Exxon Corporation).

Various additives such as inorganic fillers may be included in suitable amounts within the thermoplastic resin. Illustrative examples of suitable inorganic fillers include barium sulfate and titanium dioxide. These inorganic fillers may be surface treated to facilitate dispersion in the material.

In those cases where another material is used, the intermediate layer may likewise be formed by a known process. The process employed in such cases may be similar to the above-described intermediate layer-forming process in which the heated mixture is used.

Here, the intermediate layer is formed to a thickness of at least 0.6 mm, and preferably at least 0.9 mm, but not more than 1.6 mm, and preferably not more than 1.4 mm. If the intermediate layer is thinner than the above range, the durability to cracking will worsen and the high resilience effect of the material will decrease. Conversely, if the intermediate layer is thicker than the above range, the spin rate will increase excessively and the feel on impact will be harder.

The Shore D hardness of the intermediate layer is set to at least 45 but not more than 55. If the intermediate layer is softer than the above range, the spin rate will increase, the distance traveled by the ball will decrease, and the ball will have a smaller rebound. On the other hand, if the intermediate layer is harder than the above range, the ball will have a harder feel on impact.

The cover (outermost layer) of the inventive golf ball may be formed primarily of a thermoplastic resin or a thermoplastic elastomer. Examples include thermoplastic resins such as ionomer resins, and various types of thermoplastic elastomers. For example, use may be made of a polyester-type thermoplastic elastomer, a polyamide-type thermoplastic elastomer, a polyurethane-type thermoplastic elastomer, an olefin-type thermoplastic elastomer or a styrene-type thermoplastic elastomer. The use of an ionomer resin or a polyurethane-type thermoplastic elastomer is preferred. Examples of commercial ionomer resins, etc. that may be used include Himilan (produced by DuPont-Mitsui Polychemicals Co., Ltd.), Surlyn (E.I. DuPont de Nemours & Co.), Iotek (Exxon Corporation) and T-8190 (Dainippon Ink & Chemicals, Inc.).

Suitable amounts of various additives such as inorganic fillers may be included in the cover material. Preferred inorganic fillers include those which may be used in the above-described intermediate layer.

As with the intermediate layer, the cover may be formed of the above-described material by an injection molding process or a compression molding process.

The cover material is typically set to a higher melt flow rate than the intermediate layer material, the difference between the two preferably being at least 1.0 g/10 min. As noted subsequently, the cover is formed to a thickness of not more than 1.6 mm. In the absence of a sufficient degree of flow, cover formation will be poor, which may result in a poor cover quality.

The cover has a thickness of at least 0.6 mm, and preferably at least 0.8, but not more than 1.6 m, and preferably not more than 1.4 mm. If the cover is thinner than the above range, the durability to cracking and the scuff resistance will worsen. Moreover, if the cover is thinner than the above range, the cover rigidity will decrease and the intermediate layer will be flattened to such a degree as to diminish the high resilience effect of the intermediate layer material. On the other hand, if the cover layer is thicker than the above range, the feel of the ball will harden.

In the practice of the invention, it is essential for the intermediate layer and the cover to have a combined thickness of at least 1.8 mm, but not more than 2.8 mm. If the thickness of the intermediate layer and the cover combined is smaller than the above range, the ball will have a poor durability to cracking and a poor scuff resistance. Moreover, the high resilience effect of the intermediate layer will decrease and the cover rigidity will decrease, preventing a reduction in the spin rate. On the other hand, if the combined thickness of these two layers is greater than the above range, the ball will have a harder feel on impact, in addition to which the spin rate will increase, lowering the distance traveled by the ball.

In addition, it is essential for the cover to have a Shore D hardness of at least 63 but not more than 66. If the Shore D hardness is softer than this range, the spin rate will rise and the distance traveled by the ball will decrease. In addition, the rebound by the ball will decrease. Moreover, in such a case, the rigidity of the cover will decrease, resulting in excessive flattening of the intermediate layer, thus lowering the high resilience effect of the intermediate layer material. Conversely, if the Shore D hardness of the cover is higher than the above range, the ball will have a harder feel on impact.

No particular limitation is imposed on the deflection (mm) of the inventive golf ball when subjected to a final compressive load of 130 kgf from an initial load state of 10 kgf. However, to successfully manifest the advantageous effects of the invention, the deflection of the ball is preferably at least 2.6 mm, and more preferably at least 2.8 mm, but preferably not more than 3.5 mm, and more preferably not more than 3.3 mm. If the ball deflection is lower than the above range, the feel on impact may harden, which is undesirable. On the other hand, if the ball deflection is higher than the above range, the overall ball may undergo excessive deformation, reducing the advantageous effects of the intermediate layer.

As shown in FIG. 1, numerous dimples are formed on the surface of the inventive ball by a conventional method. To enhance the aerodynamic performance of the ball, these dimples D preferably having a surface coverage of at least 79%. The number of dimples D, although not subject to any particular limitation, is preferably set within a range of from 250 to 370, and most preferably from 270 to 350. As used herein, the "overall volume" of the dimples D on the surface of a ball, although not shown in the diagram, signifies the volume of the region enclosed by the wall of a dimple D and the curved surface defined by the land areas at the surface of the ball, summed for all the dimples on the ball. This overall volume is set to preferably from 400 to 700 $mm^3$, and especially from 450 to 650 $mm^3$. If the number, surface coverage and overall volume of these dimples are smaller than the above ranges, the lift of the ball may increase, shortening the distance of travel. On the other hand, if these parameters are higher than the above ranges, the lift of the ball may decrease, shortening the distance of travel.

In the practice of the invention, the shape of the dimples D, although not specifically shown in the diagrams, is not limited to the commonly used circular shape as seen from above. That is, it is also possible to use various distinctive dimple shapes, such as polygonal shapes (e.g., triangular, quadrangular, pentagonal and hexagonal shapes), dewdrop shapes and oval shapes, either alone or in suitable combinations thereof.

Moreover, in the present invention, because the ball is, as noted above, designed so as to have a low-spin construction, it is important to carry out a dimple design that has the effect of helping to preserve lift even in low-spin regions of the ball's trajectory after it has been struck.

The golf ball of the invention may be manufactured so as to conform with the Rules of Golf for competitive play. That is, it may be formed to a ball diameter which is not less than 42.67 mm and a weight which is not more than 45.93 g.

As explained above, in the golf ball of the present invention, by increasing the hardnesses of the cover and intermediate layer enclosing the core up to a limit that does not compromise the feel of the ball, and by also forming the intermediate layer of a specific resin mixture that is a high-resilience material, the timing of the force which suppresses the spin of the ball after it has been hit with a driver is speeded up, making it possible to achieve a reduction in the spin rate and significantly increase the distance traveled by the ball. Moreover, the ball has a good feel on impact and a high durability to cracking.

EXAMPLES

Examples of the invention and Comparative Examples are given below by way of illustration, and not by way of limitation.

Examples 1 to 4, Comparative Examples 1 to 9

Cores were produced by vulcanizing rubber compositions formulated as shown in Table 1 (ingredient amounts are indicated in parts by weight) at 155° C. for 15 minutes. In each example, the intermediate layer material of the formulation shown in Table 2 and the cover material shown in Table 3 were successively injection-molded over the core, thereby producing a three-piece solid golf ball having an intermediate layer and a cover formed about the core. The physical properties and evaluation results for the respective golf balls are presented in Table 4 (examples according to the invention) and Table 5 (comparative examples).

TABLE 1

| (parts by weight) | A | B | C | D | E | F | G |
|---|---|---|---|---|---|---|---|
| Polybutadiene | 100 | 100 | 100 | 100 | 100 | 100 | 100 |
| Polyisoprene | 0 | 0 | 0 | 0 | 0 | 0 | 0 |
| Zinc acrylate | 24.2 | 22.9 | 22.9 | 24.2 | 21.4 | 25.2 | 27.2 |

TABLE 1-continued

| (parts by weight) | A | B | C | D | E | F | G |
|---|---|---|---|---|---|---|---|
| Peroxide (1) | 0.6 | 0.6 | 0.6 | 0.6 | 0.6 | 0.6 | 0 |
| Peroxide (2) | 0.6 | 0.6 | 0.6 | 0.6 | 0.6 | 0.6 | 3 |
| Sulfur | 0 | 0 | 0 | 0 | 0 | 0 | 0.1 |
| Antioxidant | 0.1 | 0.1 | 0.1 | 0.1 | 0.1 | 0.1 | 0 |
| Zinc oxide | 29.4 | 29.9 | 38.7 | 26.6 | 30.5 | 29.0 | 27.4 |
| Zinc salt of pentachlorothiophenol | 0 | 0 | 0 | 0 | 0 | 0 | 0 |

Trade names of the primary materials appearing in Table 1 are as follows.

Polybutadiene: Produced by JSR Corporation under the trade name "BR730."

Polyisoprene: Produced by JSR Corporation under the trade name "IR2200."

Peroxide (1): Dicumyl peroxide, produced by NOF Corporation under the trade name "Percumyl D."

Peroxide (2): A mixture of 1,1-di(t-butylperoxy)cyclohexane and silica, produced by NOF Corporation under the trade name "Perhexa C-40."

Sulfur: Zinc white-sulfur mixture, produced by Tsurumi Chemical Industry Co., Ltd.

Antioxidant: Produced by Ouchi Shinko Chemical Industry Co., Ltd. under the trade name "Nocrac NS-6."

TABLE 2

| | | a | b | c | d |
|---|---|---|---|---|---|
| Ionomer | AM7318 | | | 65 | |
| | S8150 | | | | |
| | S8120 | | 75 | | 75 |
| | S8320 | 75 | | | |
| TPO | Dynaron 6100P | 25 | 25 | 35 | 25 |
| Fatty acid | Behenic acid | 20 | 20 | 20 | 20 |
| Cation source | $Ca(OH)_2$ | 4 | 4 | 4 | 2.9 |
| MFR (g/10 min) | | 0.9 | 0.9 | 0.9 | 2.1 |

Notes:
1) Formulated amounts are given in parts by weight.
2) The MFR (g/10 min) is the value obtained by measurement at a test temperature of 190° C. and a test load of 21.18 N (2.16 kgf) in accordance with JIS-K 7210.

Trade names of the primary materials appearing in Table 2 are as follows.

AM7318: An ionomer resin which is an ethylene-methacrylic acid copolymer neutralized with sodium ions. Available from DuPont-Mitsui Polychemicals Co., Ltd.

Surlyn 8150: An ionomer resin which is an ethylene-methacrylic acid copolymer neutralized with sodium ions. Available from E.I. DuPont de Nemours & Co.

Surlyn 8120: An ionomer resin which is an ethylene-methacrylic acid-acrylic acid ester copolymer neutralized with sodium ions. Available from E.I. DuPont de Nemours & Co.

Surlyn 8320: An ionomer resin which is an ethylene-methacrylic acid-acrylic acid ester copolymer neutralized with sodium ions. Available from E.I. DuPont de Nemours & Co.

Dynaron 6100P: A hydrogenated polymer (olefin-based thermoplastic elastomer) available from JSR Corporation.

Behenic acid: NAA-222S (trade name), available from NOF Corporation as a powder.

Calcium hydroxide: CLS-B, produced by Shiraishi Kogyo Kaisha, Ltd.

TABLE 3

| | | e | f |
|---|---|---|---|
| Ionomer | H1605 | | 40 |
| | H1706 | | 50 |
| | H1601 | 50 | 10 |
| | H1557 | 50 | |
| Fatty acid | Behenic acid | 0 | 0 |
| Cation source | $Ca(OH)_2$ | 0 | 0 |
| Additives | $TiO_2$ | 3 | 3 |
| | Blue | 0.04 | 0.04 |
| MFR (g/10 min) | | 2.3 | 2.5 |

Note:
Formulated amounts are given in parts by weight.

Trade names of the primary materials appearing in Table 3 are as follows.

Himilan 1605: An ionomer resin which is an ethylene-methacrylic acid copolymer neutralized with sodium ions. Available from DuPont-Mitsui Polychemicals Co., Ltd.

Himilan 1706: An ionomer resin which is an ethylene-methacrylic acid copolymer neutralized with zinc ions. Available from DuPont-Mitsui Polychemicals Co., Ltd.

Himilan 1601: An ionomer resin which is an ethylene-methacrylic acid copolymer neutralized with sodium ions. Available from DuPont-Mitsui Polychemicals Co., Ltd.

Himilan 1557: An ionomer resin which is an ethylene-methacrylic acid copolymer neutralized with zinc ions. Available from DuPont-Mitsui Polychemicals Co., Ltd.

Titanium oxide: Tipaque R550 (trade name), available from Ishihara Sangyo Kaisha, Ltd.

Blue (blue pigment): Ultramarine Blue EP-62 (trade name), available from Holliday Pigments.

TABLE 4

| | | Example | | | |
|---|---|---|---|---|---|
| | | 1 | 2 | 3 | 4 |
| Core | Diameter (mm) | 37.3 | 37.3 | 37.7 | 37.7 |
| | Formulation | A | B | A | B |
| | Deflection (mm) | 3.6 | 4.1 | 3.6 | 4.1 |
| | Initial velocity (m/s) | 76.8 | 76.8 | 76.8 | 76.8 |
| | Center hardness (Shore D) | 28 | 26 | 28 | 28 |
| | Surface hardness (Shore D) | 40 | 38 | 40 | 40 |
| | Surface - Center (Shore D) | 12 | 12 | 12 | 12 |
| Intermediate layer | Diameter (mm) | 40.0 | 40.0 | 40.2 | 40.2 |
| | Thickness (mm) | 1.35 | 1.35 | 1.25 | 1.25 |
| | Hardness (Shore D) | 51 | 51 | 51 | 51 |
| | Formulation | b | b | b | b |
| Cover | Thickness (mm) | 1.35 | 1.35 | 1.25 | 1.25 |
| | Hardness (Shore D) | 63 | 63 | 63 | 63 |
| | Formulation | f | f | f | f |
| Ball | Diameter (mm) | 42.7 | 42.7 | 42.7 | 42.7 |
| | Weight (g) | 45.4 | 45.4 | 45.4 | 45.4 |
| | Deflection (mm) | 2.8 | 3.2 | 2.9 | 3.3 |
| | Initial velocity (m/s) | 77.3 | 77.3 | 77.3 | 77.3 |
| Thickness of intermediate layer + cover (mm) | | 2.7 | 2.7 | 2.5 | 2.5 |
| Flight performance #1 (driver) HS 45 | Spin rate (rpm) | 2510 | 2480 | 2500 | 2460 |
| | Initial velocity (m/s) | 62.6 | 62.2 | 62.7 | 62.3 |
| | Distance (m) | 232.0 | 231.2 | 233.1 | 231.5 |
| Feel on impact (driver) | | soft | soft | soft | soft |
| Durability to cracking | | good | good | good | good |
| Intermediate layer MFR (g/10 min) | | 0.9 | 0.9 | 0.9 | 0.9 |
| Cover MFR (g/10 min) | | 2.5 | 2.5 | 2.5 | 2.5 |
| (Cover - Intermediate layer) MFR (g/10 min) | | 1.6 | 1.6 | 1.6 | 1.6 |

TABLE 5

| | | Comparative Example | | | | | | | | |
|---|---|---|---|---|---|---|---|---|---|---|
| | | 1 | 2 | 3 | 4 | 5 | 6 | 7 | 8 | 9 |
| Core | Diameter (mm) | 37.3 | 35.7 | 39.5 | 37.3 | 37.3 | 37.3 | 37.3 | 37.3 | 37.3 |
| | Formulation | G | C | D | B | B | B | E | F | B |
| | Deflection (mm) | 4.2 | 4.1 | 3.6 | 4.1 | 4.1 | 4.1 | 4.6 | 3.3 | 4.1 |
| | Initial velocity (m/s) | 76.8 | 76.8 | 76.8 | 76.8 | 76.8 | 76.8 | 76.8 | 76.8 | 77.0 |
| | Center hardness (Shore D) | 26 | 26 | 28 | 28 | 26 | 26 | 24 | 26 | 26 |
| | Surface hardness (Shore D) | 48 | 37 | 41 | 40 | 38 | 38 | 36 | 38 | 38 |
| | Surface - Center (Shore D) | 22 | 11 | 13 | 12 | 12 | 12 | 12 | 12 | 12 |
| Intermediate layer | Diameter (mm) | 40 | 39.2 | 41.1 | 40 | 40 | 40 | 40 | 40 | 40 |
| | Thickness (mm) | 1.35 | 1.75 | 0.8 | 1.35 | 1.35 | 1.35 | 1.35 | 1.35 | 1.35 |
| | Hardness (Shore D) | 51 | 51 | 51 | 42 | 58 | 51 | 51 | 51 | 51 |
| | Formulation | b | b | b | a | c | b | b | b | d |
| Cover | Thickness (mm) | 1.35 | 1.75 | 0.8 | 1.35 | 1.35 | 1.35 | 1.35 | 1.35 | 1.35 |
| | Hardness (Shore D) | 63 | 63 | 63 | 63 | 63 | 60 | 63 | 63 | 63 |
| | Formulation | f | f | f | f | f | e | f | f | f |

TABLE 5-continued

| | | Comparative Example | | | | | | | | |
|---|---|---|---|---|---|---|---|---|---|---|
| | | 1 | 2 | 3 | 4 | 5 | 6 | 7 | 8 | 9 |
| Ball | Diameter (mm) | 42.7 | 42.7 | 42.7 | 42.7 | 42.7 | 42.7 | 42.7 | 42.7 | 42.7 |
| | Weight (g) | 45.4 | 45.6 | 45.3 | 45.4 | 45.4 | 45.4 | 45.4 | 45.4 | 45.4 |
| | Deflection (mm) | 3.2 | 3.0 | 3.0 | 3.3 | 3.1 | 3.3 | 3.6 | 2.5 | 3.2 |
| | Initial velocity (m/s) | 77.3 | 77.5 | 77.3 | 77.2 | 77.4 | 77.2 | 77.3 | 77.3 | 77.3 |
| Thickness of intermediate layer + cover (mm) | | 2.7 | 3.5 | 1.6 | 2.7 | 2.7 | 2.7 | 2.7 | 2.7 | 2.7 |
| Flight performance #1 (driver) HS 45 | Spin rate (rpm) | 2620 | 2650 | 2630 | 2610 | 2450 | 2660 | 2450 | 2710 | 2580 |
| | Initial velocity (m/s) | 62.3 | 62.7 | 62.5 | 62.3 | 62.4 | 62.0 | 61.2 | 63.1 | 62.2 |
| | Distance (m) | 228.5 | 227.8 | 228.2 | 228.6 | 232.5 | 227.2 | 228.6 | 229.1 | 229.4 |
| Feel on impact (driver) | | soft | hard | soft | soft | hard | soft | soft | hard | soft |
| Durability to cracking | | good | good | NG | good | fair | good | NG | good | good |
| Intermediate layer MFR (g/10 min) | | 0.9 | 0.9 | 0.9 | 0.9 | 0.9 | 0.9 | 0.9 | 0.9 | 2.1 |
| Cover MFR (g/10 min) | | 2.5 | 2.5 | 2.5 | 2.5 | 2.5 | 2.3 | 2.5 | 2.5 | 2.5 |
| (Cover - Intermediate layer) MFR (g/10 min) | | 1.6 | 1.6 | 1.6 | 1.6 | 1.6 | 1.4 | 1.6 | 1.6 | 0.4 |

Details concerning tests and evaluations conducted on the physical properties, flight performance, feel on impact, and durability to cracking of the golf balls obtained in the examples of the invention and the comparative examples are given below.

Deflection of Core and Ball

The deformation (mm) of a core or golf ball when subjected to a final compressive load of 130 kgf from an initial load state of 10 kgf.

Core Center Hardness, Core Surface Hardness

These are Shore D hardnesses; that is, hardnesses as measured with an ASTM D2240 type D durometer. The core surface hardness was measured at the surface of the core. The core center hardness was measured at the center of a core that had been cut in half.

Intermediate Layer Hardness, Cover Hardness

These are Shore D hardnesses; that is, hardnesses as measured with an ASTM D2240 type D Durometer, based on JIS K-6253. Each of these hardnesses refers not to the surface hardness of the sphere covered by the intermediate layer or the cover, but rather to the measured surface hardness of a resin sheet.

Flight Performance

The distance traveled by the ball when hit at a head speed (HS) of 45 m/s with a driver (TourStage X-Drive Type 405, manufactured by Bridgestone Sports Co., Ltd.; loft angle, 9.5°) mounted on a swing robot (Miyamae Co., Ltd.) was measured. The initial velocity and spin rate were measured from high-speed camera images of the ball taken immediately after impact.

Feel on Impact

Each ball was hit by five skilled amateur golfers having handicaps of less than 10, and assigned a score of 1 to 5 according to the following criteria.

5: Very soft
4: Soft
3: Ordinary
2: Hard
1: Very hard

The scores obtained for each ball were then averaged, based on which the feel of the ball was assigned one of the three ratings indicated below.

Soft: Average score for the five golfers was above 4
Ordinary: Average score for the five golfers was from 2 to 4
Hard: Average score for the five golfers was below 2

Durability to Cracking

The number of shots that had been taken with the ball in Example 2 when its initial velocity fell below 97% of the average initial velocity for the first 10 shots was assigned a durability index of "100," based upon which durability indices for the balls in the other examples were determined. The durabilities of the balls in the respective examples were rated according to the following criteria. The average value for N=3 balls was used as the basis for evaluation in each example.

Good: Durability index was 110 or more
Fair: Durability index was at least 90 but less than 110
NG: Durability index was less than 90

As is apparent from the results in Table 5, because the golf balls obtained in the comparative examples had the ball constructions indicated below, they were inferior to the golf balls of the present invention (Table 4) in at least one of the ball characteristics assessed. The details are given below.

In Comparative Example 1, the core had a large hardness distribution, resulting in a high spin rate on shots with a driver (number 1 wood).

In Comparative Example 2, the large combined thickness of the intermediate layer and the cover resulted in a high spin rate and a poor distance. Moreover, the ball had a hard feel on impact.

In Comparative Example 3, the small combined thickness of the intermediate layer and the cover resulted in a high spin rate and a poor distance. Moreover, the ball had a poor durability to cracking.

In Comparative Example 4, the intermediate layer was too soft, resulting in a high spin rate and a poor distance.

In Comparative Example 5, the intermediate layer was too hard, resulting in a hard feel on shots with a driver (number 1 wood). Moreover, the durability to cracking was poor.

In Comparative Example 6, the cover was too soft, resulting in a high spin rate and a poor distance.

In Comparative Example 7, the finished ball was too soft, lowering the initial velocity. As a result, the ball had a poor distance. Moreover, the durability to cracking was poor.

In Comparative Example 8, the finished ball was too hard, as a result of which the ball had a high spin rate and a poor distance. Moreover the ball had a hard feel on impact.

In Comparative Example 9, because the intermediate layer had a low degree of neutralization, the ball had a low rebound, slowing down the timing of the force that acts to suppress the spin rate. As a result, the ball ended up having a high spin rate and thus a short distance.

In Examples of the golf ball, the added amount of pentachlorothiophenol is 0 part by weight in the composition of the core and the degree of neutralization of the cover is set comparatively lower. That is, both of the core and the cover are made to lower rebound or low resilience, and the degree of neutralization of the intermediate layer is further enhanced to improve its resilience, so that a ball construction is created so as to bring about a spin rate-lowering effect of a highly resilient intermediate layer.

The invention claimed is:

1. A golf ball comprising a core, an intermediate layer which encases the core, and a cover which encases the intermediate layer, wherein the core has a diameter of between 36 and 40 mm and a deflection of between 3.5 and 4.2 mm, the intermediate layer has a Shore D hardness of between 45 and 55 and a thickness of between 0.6 and 1.6 mm, the cover has a Shore D hardness of between 63 and 66 and a thickness of between 0.6 and 1.6, the ball as a whole has a deflection of between 2.6 and 3.5 mm, the intermediate layer and cover have a combined thickness of between 1.8 and 2.8 mm, the ball has a hardness design such that the Shore D hardnesses of the ball components satisfy the relationship core center≦core surface≦intermediate layer≦cover, the cover is made of a material composed primarily of a thermoplastic resin or a thermoplastic elastomer, and the intermediate layer is made of a material that is a resin composition containing a heated mixture which has a melt flow rate according to JIS K-7210 of 0.5 to 1.0 g/l 0 mm and which is selected from among (I) to (III) below:

(I)

(a) 100 parts by weight of an olefin-unsaturated carboxylic acid random copolymer and/or an olefin-unsaturated carboxylic acid-unsaturated carboxylic acid ester random copolymer, (b) from 5 to 80 parts by weight of a fatty acid or fatty acid derivative having a molecular weight of at least 280, and (c) from 0.1 to 20 parts by weight of a basic inorganic metal compound capable of neutralizing the acid groups in components (a) and (b);

(II)

(d) 100 parts by weight of a metal ion neutralization product of an olefin-unsaturated carboxylic acid random copolymer and/or a metal ion neutralization product of an olefin-unsaturated carboxylic acid-unsaturated carboxylic acid ester random copolymer, (b) from 5 to 80 parts by weight of a fatty acid or fatty acid derivative having a molecular weight of at least 280, and (c) from 0.1 to 20 parts by weight of a basic inorganic metal compound capable of neutralizing the acid groups in components (d) and (b);

(III)

100 parts by weight of, in admixture, (a) an olefin-unsaturated carboxylic acid random copolymer and/or an olefin-unsaturated carboxylic acid-unsaturated carboxylic acid ester random copolymer and (d) a metal ion neutralization product of an olefin-unsaturated carboxylic acid random copolymer and/or a metal ion neutralization product of an olefin-unsaturated carboxylic acid-unsaturated carboxylic acid ester random copolymer, (b) from 5 to 80 parts by weight of a fatty acid and/or fatty acid derivative having a molecular weight of at least 280, and (c) from 0.1 to 20 parts by weight of a basic inorganic metal compound capable of neutralizing the acid groups in components (a), (d) and (b); at least 90% of the acid groups in the resin composition being neutralized, wherein the cover material and the intermediate layer material have a melt flow rate difference therebetween of at least 1.0 g/l 0 mm.

2. The golf ball of claim 1, wherein 100 mol % of the acid groups in the resin composition serving as the intermediate layer material are neutralized.

3. The golf ball of claim 1, wherein the core has a difference in Shore D hardness between the core surface and the core center of from 5 to 15.

4. The golf ball of claim 1 which has a surface on which a plurality of dimples are formed, the dimples numbering in all from 250 to 370, having an overall volume of from 400 to 700 $mm^3$, and having a surface coverage of at least 79%.

5. The golf ball of claim 1, wherein the center of the core has a Shore D hardness of 15 to 28 and the surface of the core has a Shore D hardness of 30 to 50.

6. The golf ball of claim 1, wherein pentachlorothiophenol is not included in the core.

7. The golf ball of claim 1 which has a surface on which a plurality of dimples are formed, the dimples numbering in all from 270 to 350.

8. The golf ball of claim 1 which has a surface on which a plurality of dimples are formed, the dimples having an overall volume of from 450 to 650 $mm^3$.

9. The golf ball of claim 1 which has a surface on which a plurality of dimples are formed, the dimples numbering in all from 270 to 350 and having an overall volume of from 450 to 650 $mm^3$.

* * * * *